US005174379A

United States Patent [19]

Whiteley et al.

[11] Patent Number: 5,174,379

[45] Date of Patent: Dec. 29, 1992

[54] GRAVEL PACKING AND PERFORATING A WELL IN A SINGLE TRIP

[75] Inventors: Thomas G. Whiteley, Houston; Travis W. Cavender, Angleton, both of Tex.

[73] Assignee: Otis Engineering Corporation, Carrollton, Tex.

[21] Appl. No.: 653,400

[22] Filed: Feb. 11, 1991

[51] Int. Cl.[5] ..... E21B 43/04

[52] U.S. Cl. ..... 166/278; 166/51; 166/318; 166/126; 166/131

[58] Field of Search ..... 166/278, 51, 151, 318, 166/131, 126, 133, 142

[56] References Cited

U.S. PATENT DOCUMENTS

| | | | |
|---|---|---|---|
| 3,960,366 | 6/1976 | Abney et al. | 166/51 X |
| 4,372,384 | 2/1983 | Kinney | 166/278 |
| 4,519,451 | 5/1985 | Gray et al. | 166/131 X |
| 4,540,051 | 9/1985 | Schmuck et al. | 166/51 X |
| 4,541,486 | 9/1985 | Wetzel et al. | 166/51 X |
| 4,566,538 | 1/1986 | Peterson | 166/55 X |
| 4,733,723 | 3/1988 | Callegari, Sr. | 166/51 |
| 4,880,056 | 11/1989 | Nelson et al. | 166/51 |
| 4,944,348 | 7/1990 | Whiteley et al. | 166/278 |
| 4,951,750 | 8/1990 | Wetzel | 166/278 |

OTHER PUBLICATIONS

"One-Trip, Multizone Gravel-Packing Technique for Low-Pressure, Shallow Wells", by John B. Welrich, Theodore E. Zaleski, Jr., and Steve L. Tyler, pp. 356-360, SPE Production Engineering, Nov. 1990.

*Primary Examiner*—Thuy M. Bui
*Assistant Examiner*—Roger J. Schoeppel
*Attorney, Agent, or Firm*—Arnold, White & Durkee

[57] ABSTRACT

A new gravel packing system is provided whereby a well may be perforated, gravel packed and placed on production with a single trip of the tool string into the well. The system will include a crossover assembly which has a closure mechanism operatively associated therewith. The closure mechanism may be operated to preclude downward fluid flow through the crossover tool, to establish at least a portion of a downward gravel pack slurry flow path, and to establish at least a part of a carrier fluid return flow path. At the conclusion of a gravel pack operation, the closure member may be either withdrawn from the assembly or expelled to the bottom of the wellbore, leaving the tool to be placed on production without tripping the tool string.

16 Claims, 9 Drawing Sheets

FIG. 2C
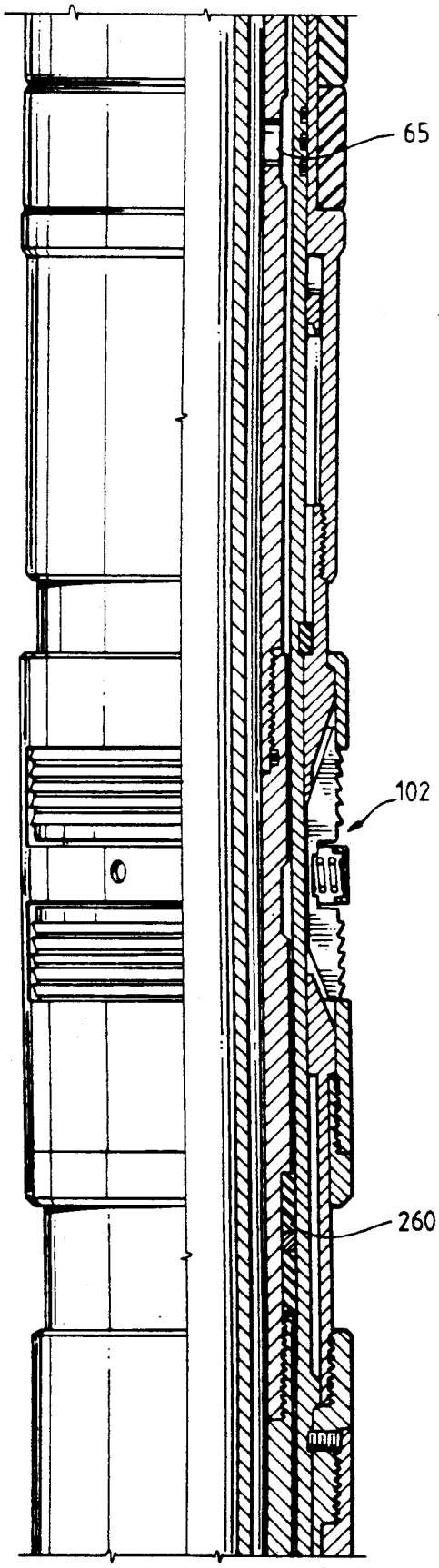
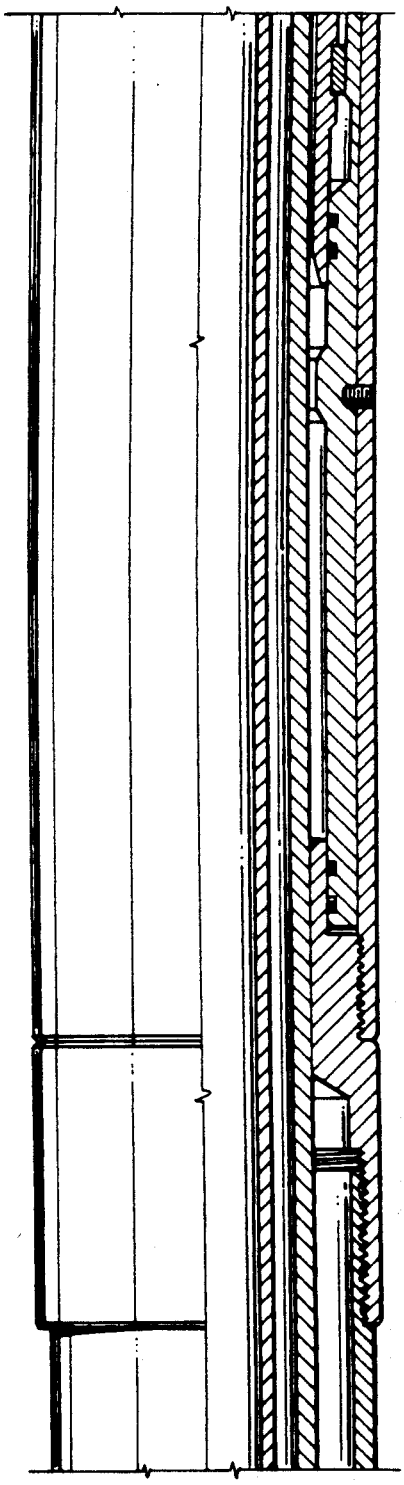
FIG. 2D

FIG.5
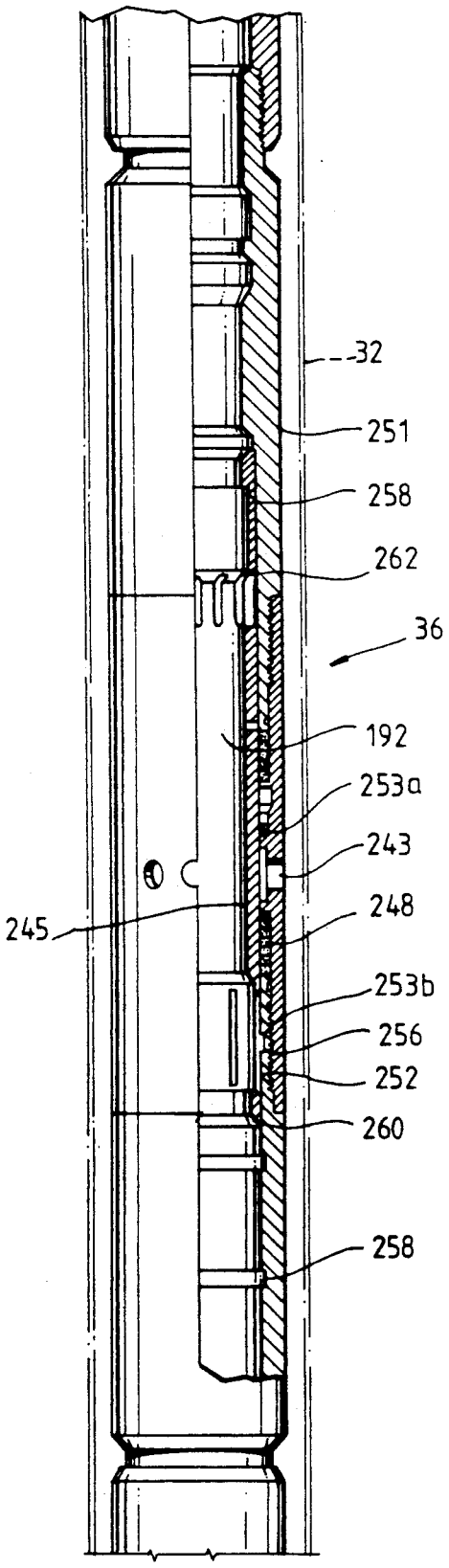
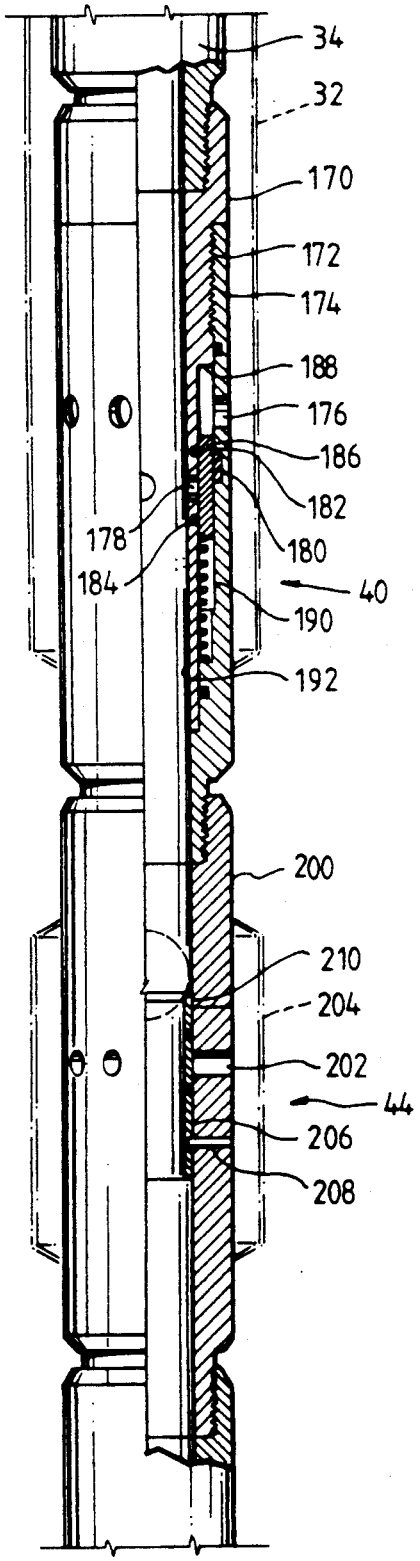
FIG.4

FIG.8
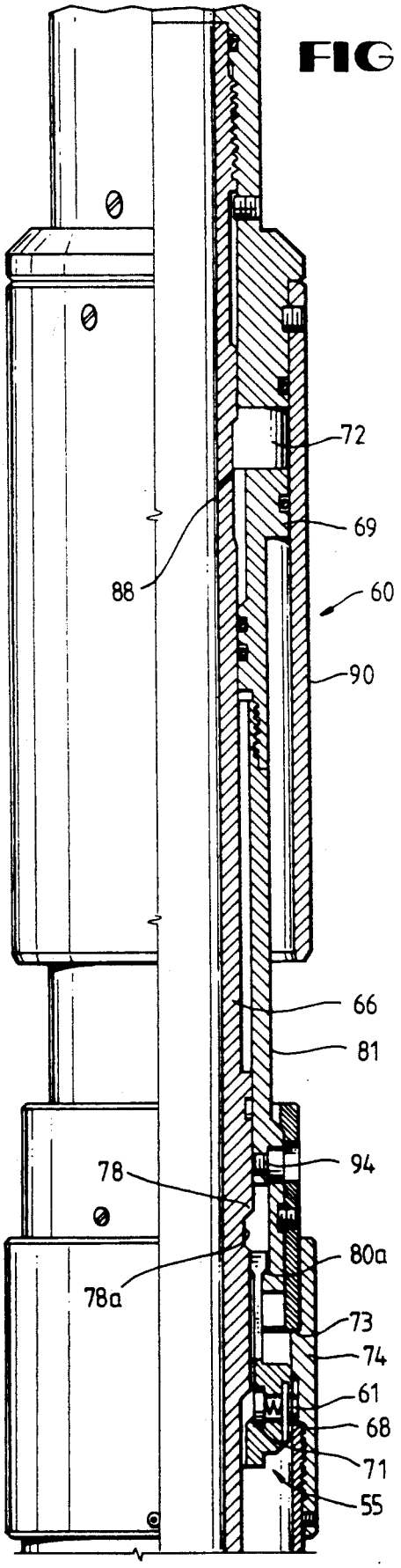
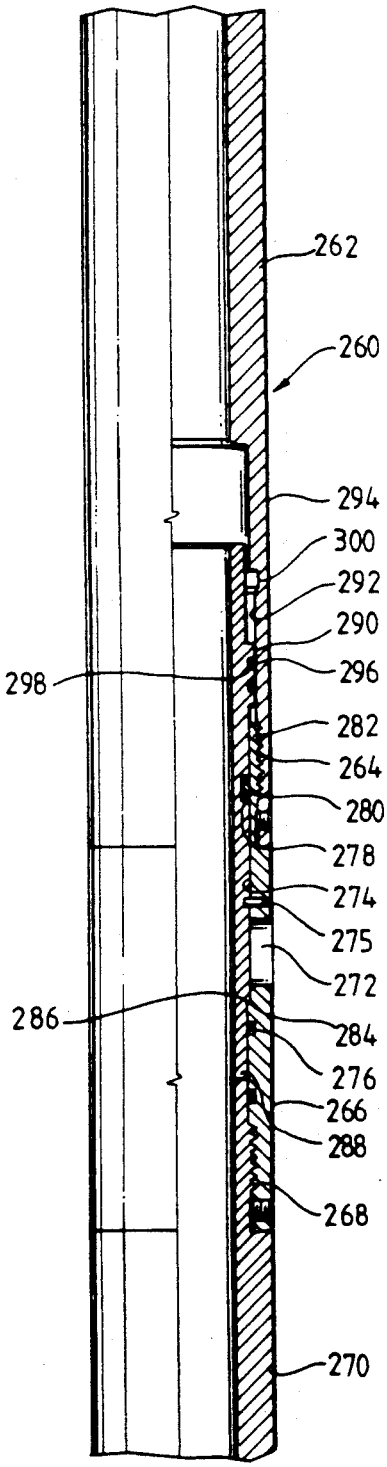
FIG.9

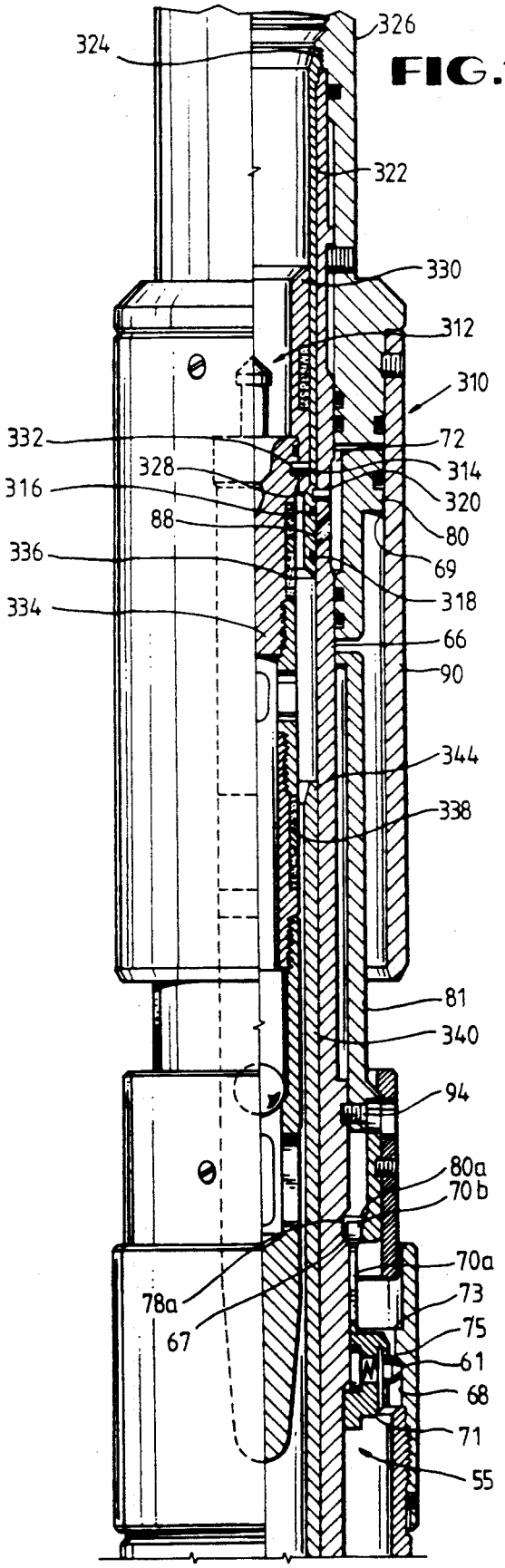
FIG.10A
FIG.10B
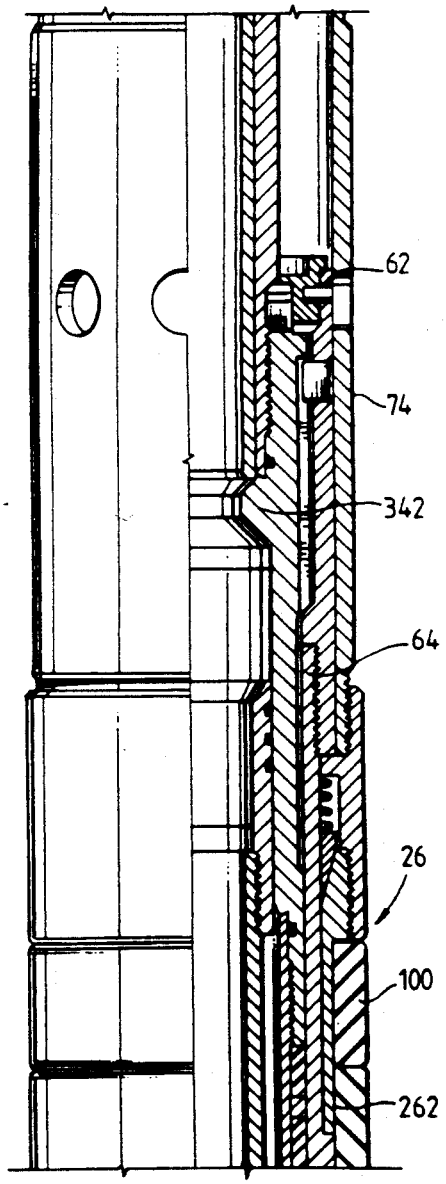

GRAVEL PACKING AND PERFORATING A WELL IN A SINGLE TRIP

BACKGROUND OF INVENTION

The present invention relates generally to methods and apparatus for gravel packing a well, and, more specifically relates to methods and apparatus for gravel packing a well with only a single trip of the tool string into the wellbore, which method may also provide for the perforating of the well on such single trip.

Techniques are well known in the oil and gas industry for controlling sand migration into wells penetrating unconsolidated formations by gravel packing the wells. Such gravel packing typically consists of depositing a quantity, or "pack," of gravel around the exterior of a perforated liner and screen, with the pack preferably extending into the perforations in the unconsolidated formation. The gravel pack then presents a barrier to the migration of the sand while still allowing fluid to flow from the formation. In placing the gravel pack, the gravel is carried into the well and into the formation in the form of a slurry, with the carrier fluid or workover fluid being returned to the surface, leaving the gravel in the desired location.

Attempts have been made in the past to minimize the number of trips of the tool string into the well. Each trip of the tool string into a well takes an appreciable amount of time, and therefore incurs significant costs in terms of rig and crew time. As will be readily apparent, these costs are dramatically increased if the tool string is tripped to a great depth in a well.

Previous attempts to minimize trips into the borehole for gravel packing have only allowed the actual gravel packing operation to be performed in a single trip, but have not allowed the well to be placed on production at the end of that trip. Thus, with conventional so-called "one-trip" techniques, after a single trip into the borehole for gravel packing, the tubing and at least a portion of the tool string would have to be tripped out of the hole, and other equipment, such as a seal assembly or extension tripped into the hole to stab into the production packer to place the well on production. Examples of such prior art techniques are disclosed in U.S. Pat. No. 4,372,384, issued Jan. 10, 1983, and U.S. Pat. No. 4,566,538issued Jan. 28, 1986.

Accordingly, the present invention provides new methods and apparatus whereby a well may be gravel packed and placed on production with a single trip of the tool string and tubing into the wellbore. Additionally, the well may first be perforated on this same, single, trip into the wellbore.

SUMMARY OF THE INVENTION

New methods and apparatus in accordance with the present invention will preferably include a packer assembly and a crossover assembly. The crossover assembly is capable of having an open bore therethrough, but is selectively operable to provide a first flow path from the interior of the tubing string at a location above the packer to the wellbore annulus below the packer, and is further selectively operable to provide a second flow path from the interior of the tool string below the packer to the annulus in the wellbore above the packer. The apparatus also preferably includes an operating mechanism which is selectively associatable with the crossover assembly for closing the open bore and for selectively operating the crossover tool, at least in part, to establish the described flow paths.

In one preferred embodiment, the operating mechanism will be a probe, or "dart," assembly which may be lowered into the wellbore after the crossover assembly is in the well, Such lowering may be either by dropping the probe or by wireline. In this preferred embodiment, the probe will engage a movable sleeve in the crossover assembly to preclude fluid flow through the crossover assembly, at least at a first pressure level within the tubing string. This occlusion of fluid flow facilitates the establishing of a first pressure in the tubing string to set the packer within the wellbore. In this preferred embodiment, the crossover assembly will have a movable sleeve which will then be shifted in response to a second, higher, pressure level in the wellbore. In one preferred embodiment, the probe assembly will be seated within this movable sleeve. The described sleeve movement will also establish the first flow path, and will also establish a portion of the second flow path. In this preferred embodiment, the apparatus will include a valve located within a conventional gravel pack screen, which valve is operable to complete the lower portion of said flow path. The crossover assembly will also be selectively manipulable by longitudinal movement to establish the upper portion of this flow path.

Once the described flow paths are established, the well may be gravel packed in a conventional manner. After the gravel pack is complete, however, the well may be placed on production without removing any portions of the crossover assembly or packer assembly from the wellbore. As noted earlier herein, this is in clear contrast to prior art designs. In a particularly preferred method of practicing the present invention, the probe will be removed from the well either by withdrawing it from the top by wireline or by pressuring it out the bottom of the assembly, leaving the open interior bores of the crossover assembly and the remaining components in a condition suitable for producing fluids from the well.

BRIEF DESCRIPTION OF THE DRAWINGS

FIGS. 2A–E depict the packet/crossover assembly of FIG. 1, illustrated partially in vertical section.

FIG. 4 depicts the differential pressure operated valve and tell-tale screen assembly of FIG. 1, illustrated partially in vertical section.

FIG. 5 depicts the crossover sleeve assembly of FIG. 1, illustrated partially in vertical section.

FIG. 8 depicts a portion of the service tool assembly of the packer/crossover assembly of FIGS. 2A–E at one stage of operation, illustrated partially in vertical section.

FIG. 9 depicts an alternative embodiment of the sliding sleeve valve of the perforating/gravel pack assembly of FIG. 1, illustrated partially in vertical section.

FIGS. 10A-B depict an alternative embodiment of a multipurpose running tool and a closure assembly suitable for use with the present invention, and illustrated partially in vertical section.

DETAILED DESCRIPTON OF A PREFERRED EMBODIMENT

Figure 1A:
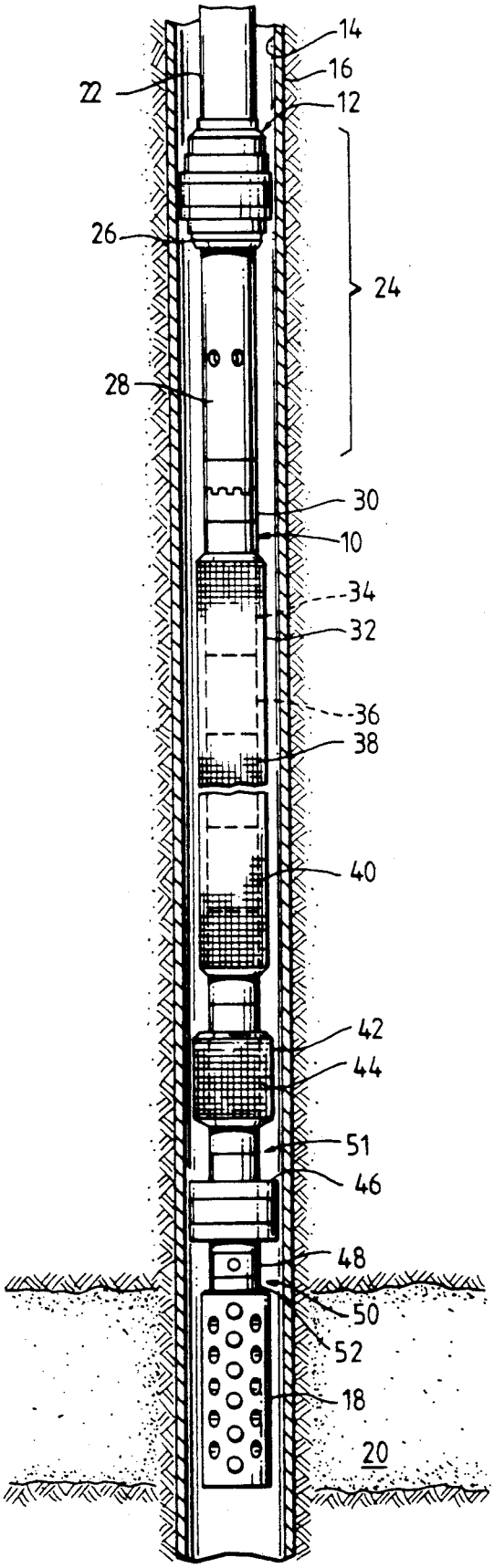
FIGS. 1A–C depict a perforating/gravel pack assembly in accordance with the present invention; the assembly is depicted in FIG. 1A as disposed in a wellbore, and is depicted in part in FIGS. 1B and C in different stages of a perforating/gravel pack operation.
Figure 1B:
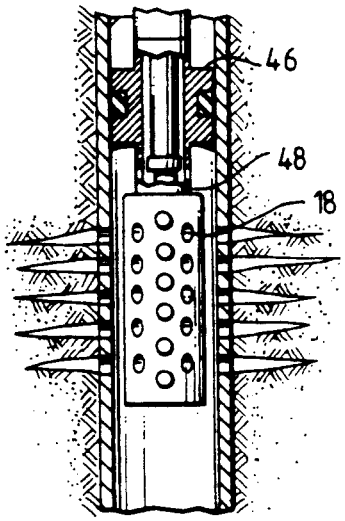
Figure 1C:
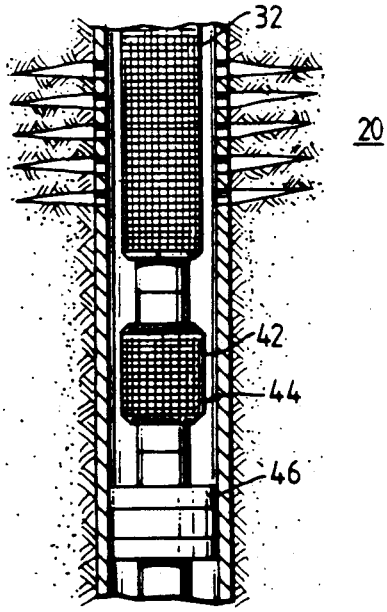

Referring now to the drawings in more detail, and particularly to FIGS. 1A-C, therein is depicted in FIG. 1A an exemplary perforating/gravel pack apparatus 10 in accordance with the present invention. Perforating/-gravel pack apparatus 10 is shown disposed within a cased wellbore 12. Casing 14 is placed and secured in the borehole 16 by conventional cementing techniques. Perforating/gravel pack apparatus 10 is shown disposed in wellbore 12 at a depth which positions perforating gun 18 adjacent a zone of interest 20. Perforating gravel pack apparatus 10 is suspended from a tubing string 22. As will be apparent from the discussion to follow, tubing string 22 may be any type of appropriate tubular member, such as drill pipe, a work string, etc.; however, tubing string 22 will preferably be production tubing. since at the completion of the perforating and gravel packing operation, the well may be then placed directly on production.

Perforating gravel pack apparatus 10 includes a packer/crossover assembly 24. Packer/crossover assembly 24 includes a packer 26. Packer 26 is preferably a hydraulically set packer such as the Versa-Trieve® retrievable Packer manufactured and sold by Otis Engineering Corporation. Coupled to packer 26 will be a crossover assembly 28 which will be described in more detail later herein. Beneath crossover assembly 28 is a non-rotating shear sub 30. Coupled in perforating/-gravel pack apparatus 10 beneath shear sub 30 is primary gravel pack screen 32. Gravel pack screen 32 is secured around housing 34 in a conventional manner. Coupled within housing 34 is at least one sleeve valve 36 as will be described in more detail later herein. Sleeve valve 36 is preferably a sliding sleeve type valve which allows selective opening of a port 38 to allow fluid communication, through screen 32, between wellbore 12 and the interior of housing 34.

Coupled in exemplary perforating/gravel pack apparatus 10 is also an optional differential pressure operated circulating valve 40. Housing assembly 34 extends through screen 32, and through tell-tale screen 42. Tell-tale screen is secured a short distance beneath primary gravel pack screen 32. Within tell-tale screen 42, housing assembly 34 includes a sliding sleeve valve 44. Sliding sleeve valve 44 is preferably a ball-operated valve, which includes a seating surface to receive a sealing ball, by which the sleeve may then be moved by application of hydraulic pressure. Beneath valve 44 is packer 46. Packer 46 is preferably a mechanically-set retrievable packer, such as the Perma Lach® packer manufactured and sold by Otis Engineering Corporation. Perforating equipment located in perforating/gravel pack apparatus 10 beneath packer 46 may be of virtually any conventional type, including various types of vent assemblies, as desired. In the illustrative embodiment depicted, the perforating equipment includes a ported sub 48 to allow fluid communication between a lower annulus 50, located beneath packer 46, and the interior of housing assembly 34 and tubing string 22. Perforating equipment also includes an appropriate firing head 52 such as a mechanically-actuated firing head. However, as will be readily apparent, annulus or tubing pressure actuated firing heads could also be utilized. Firing head 52 is operably coupled to perforating gun 18, which may consist of one or more guns of virtually any conventional type.

Referring now to FIGS. 2A-E, therein is depicted packer and crossover assembly 24 in greater detail. Packer 26 may be of any appropriate type, but preferably is a hydraulically actuated packer. Packer 26 is shown in combination with a multi-position running tool, indicated generally at 60, also such as is manufactured and sold by Otis Engineering Corporation. The structure and operation of multi-position service tool 60 is described and illustrated in U.S. Pat. No. 4,832,129, issued May 23, 1989, to Sproul, et al. and assigned to Otis Engineering Corporation. The disclosure, including the specificaton of U.S. Pat. No. 4,832,129 is incorporated herein by reference for all purposes. The disclosure and specification of U.S. Pat. No. 4,834,175, issued May 30, 1989, and also assigned to the assignee of the present invention is also incorporated herein by reference. U.S. Pat. No. 4,834,175 discloses an exemplary embodiment of a Versa-Trieve packer suitable for use with the present invention.

Briefly, multi-position service tool 60 attaches to packer 26 in such a way as to enable the packer to be run and set, and for the tool to be released from the packer, all without rotation of service tool 60. Packer 26 will be set in response to the application of hydraulic pressure, which causes movement of an actuation piston which shears restraining shear pins and causes the setting sleeve of multi-position service tool 60 to bear against a guide on the packer, moving the outer parts of the packer relative to a packer mandrel, thereby expanding packer seals 100 and setting packer slips 102.

The structure and operation of multi-position service tool 60 in combination with packer 26 will be outlined briefly. A group of separation shear pins 62 having a shear strength sufficient to, at a minimum, support the packer assembly hang weight connect the packer mandrel 64 to service tool mandrel 66. During run-in, packer 26 is mechanically locked in an unset condition by separation shear pins 62.

Separation shear pins 62 are decoupled with respect to run-in handling forces by a transfer support assembly, indicated generally at 67. Transfer support assembly 67 includes a plurality of transit support lugs 68 carried by a collet assembly 70 which is selectively movably mounted relative to service tool piston mandrel 76. Transit support lugs 68 carry the weight of the packer and any weight of equipment hanging therefrom so that the hang weight of that equipment is not applied to separation shear pins 62 during the run-in procedure.

Transit support lugs 68 are engaged against an annular flange 72 which is formed on a tube guide extension 74. Transit support lugs 68 engage an underside 61 of annular flange 75, with the upper surface 73 of flange 72 being aligned for engagement with a setting sleeve 76, and to serve as a stop therefore. The hang weight of packer and crossover assembly 24 is communicated through tube guide extension 74 and through transit lugs 68 and collet assembly 70 to service tool mandrel 66. This described system isolates the handling forces arising during the run-in procedure from separation shear pins 62.

Service tool mandrel 66 includes a locking flange 78 with a recess which is engaged by a shoulder portion 71 of collet 70. Shoulder portion 71 limits the upward movement of collet 70. Collet 70 includes finger portions 70*a* having enlarged radially inwardly extending head portions 70*b*. Collet head portions 70*b* are retained in a detent groove 67 in multiposition tool mandrel 66. Detent groove 67 is located above the portion of locking flange 78 engaged by shoulder portion 71 of collet 70. Head portion 70*b* of collet 70 is engaged and prevented from deflecting by a piston shoulder 80*a* on an annular piston 80. Piston 80 is adapted for sliding movement along surface tool mandrel 76.

Transit lugs 68 are released, and the packer is set, by pressurizing fluid within the interior of the tubing string. Pressurized fluid within the tubing will be communicated through a port 88 in tool mandrel 66 to act upon piston 80 to cause setting of packer 26, after closing the bore of the tubing string, such as through use of a probe or "dart" assembly 220, as will be described in more detail later herein. Once a downward path through the tubing string is closed, fluid may be pressurized within the tubing. This fluid traverses port 88 to annulus 72 and acts upon piston 80. Pressure on piston 80 will cause shearing of transit shear pins 94, and subsequent downward movement of piston 80, as depicted in FIG. 8. Piston 80 is coupled to an extension sleeve 81 which, in turn, is coupled to tool mandrel locking flange 78 through transit shear pins 94. Upon shearing of transit shear pins 94, piston 80 will drive service tool piston mandrel 76 downwardly against shoulder 73 of tube guide extension 72. Collet 70 remains in place as the piston is driven downwardly. Piston shoulder 80 will clear collet head 70, thereby allowing it to deflect, and also permitting the collet transfer assembly to move downwardly along the locking ring 78; and permitting the spring loaded support lugs 68 to retract inwardly. As transit support lugs 68 retract, the hang weight of the packer is transferred from transit support lugs 68 to separation shear pins 62.

Tube guide extension 74 is moveable relative to packer mandrel 64. Upper seal 100 and slips 102 are connected to tube guide extension 74 by a connecting sub 96. An internal locking slip ring assembly 98 is restrained within an annulus 97 between connecting sub 96 and packer mandrel 64. Slip ring assembly 98 is biased by a coil spring 99. Slip ring assembly 98 functions as an internal slip which prevents reverse movement of tube guide extension 74 relative to packer mandrel 64. Accordingly, tube guide extension 74 will move downwardly relative to packer mandrel 64 in response to continued extension of piston 68 and attached extension sleeve 81. As piston 80 nears the limit of its extension along tool mandrel 66, slips 102 and seals 100 will engage the casing and set packer 24 against the inside bore of the well casing.

Because packer mandrel 64 is anchored onto tool mandrel 66 by separation shear pins 62, guide tube extension 74 continues its downward movement relative to packer mandrel 64. Once the desired slip setting pressure has been achieved and packer 26 is securely anchored in place, service tool 60 can be released from packer 26 by increasing hydraulic pressure, and/or by pulling tubing string 22 upwardly, to cause shearing of separation shear pins 62. Once separation shear pins 62 are sheared, transfer support lugs 68 may retract radially inwardly against spring 69, thereby permitting service tool 60 to be reciprocated freely within the bore of packer 26.

Figure 2A:
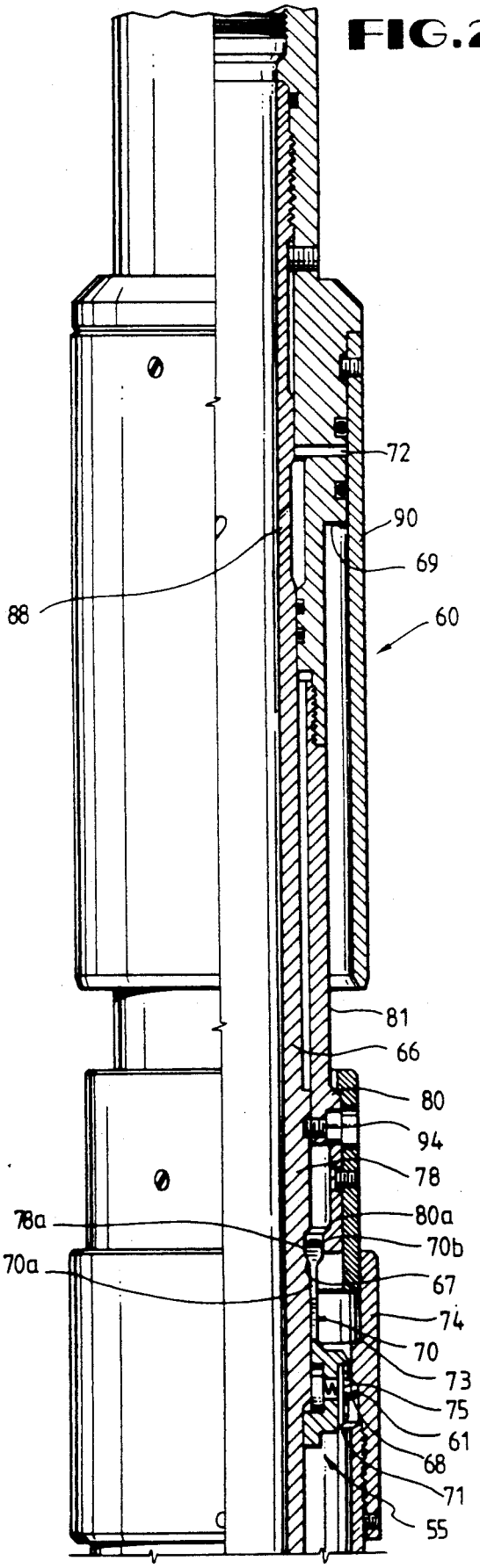
Figure 2B:
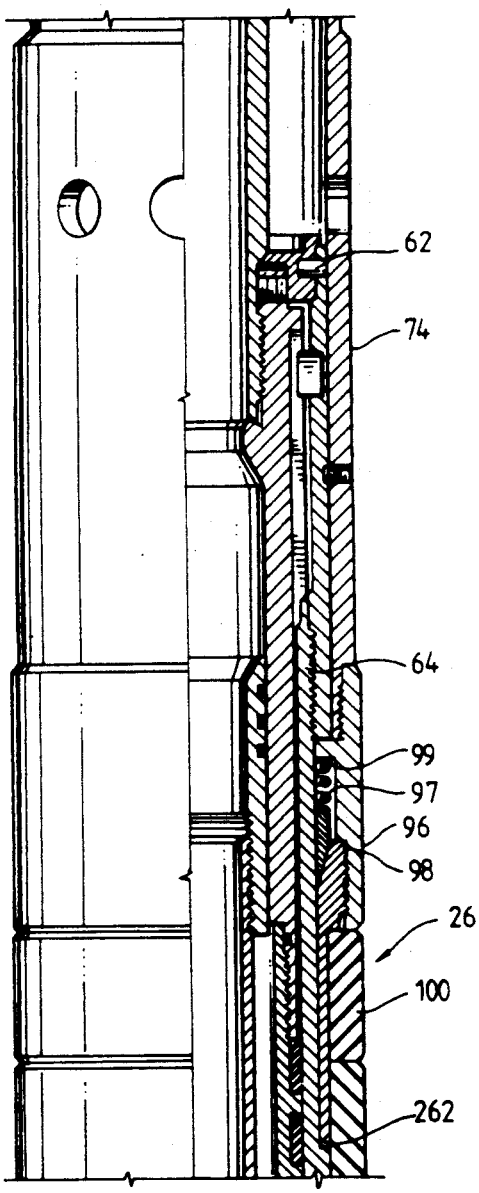
Figure 2E:
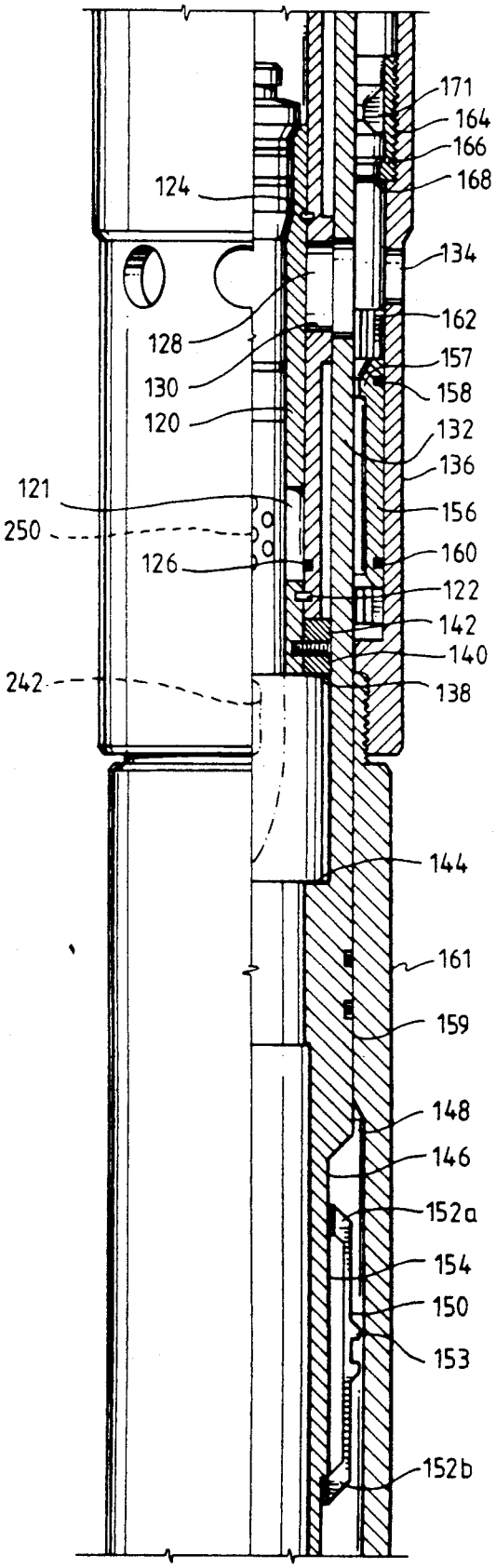

Referring now primarily to FIG. 2E, therein is depicted a portion of the mechanism for selectively closing bore 121 of packer and crossover tool assembly tool 24. A closing mandrel 120 is secured, such as by a shear pin 122 within multi-position service tool mandrel 56. Multi-position service tool mandrel 66 includes seals 124, 126 located on opposite sides of a radial aperture 128. Seals 124 and 126 are adapted to engage the exterior of closing sleeve 120, so as to isolate radial aperture 128. Radial aperture 128 is longitudinally aligned with a radial aperture 130 in crossover sleeve 132 and radial aperture 134 in crossover housing member 136. A closing probe, or "dart assembly" is depicted in dashed lines within closing sleeve 120. The structure and operation of dart assembly 220 is depicted later herein in connection with the description of the operation of perforating/gravel pack assembly 10.

Also coupled to closing sleeve 120 is a shearable stop block assembly, indicated generally at 138. Shearable stop block assembly 138 includes stop block 140 which is coupled by a shear pin 142 to closing sleeve 120. The purpose of shearable stop block assembly 138 will be described in more detail later herein.

As can also be seen in FIG. 2E, beneath radial aperture 130 in crossover sleeve 132 is a stop ledge 144 which will selectively engage and restrict downward movement of stop block assembly 138. Beneath stop ledge 144 is a radially inset sleeve portion 146 of crossover mandrel 132. Radially inset sleeve portion 146 provides sufficient clearance in annular area 148 to accommodate a bow-type collet spring assembly, indicated generally at 150. Bow-type collet spring assembly 150 preferably includes a mechanism, such as two radially inwardly extending shoulders 152*a*, 152*b* which engage either side of a radially outwardly extending ledge 154 on sleeve portion 146. Bow-type collet spring assembly 150 also includes a radially outwardly extending ledge 153 which is adapted to selectively engage an inwardly extending ledge 157 on a sliding valve member 156. Bow-type collet spring assembly 150 is sized so as to be deflectable to pass beneath radially inwardly extending surface 159 of housing extension 161, and also to radially expand so as to engage ledge 157 of sliding valve member 156, upon upward longitudinal movement of sleeve portion 146 of crossover mandrel 132.

Sliding valve member 156 is located immediately beneath radial apertures 130 and 134. Sliding valve member 156 is adapted to selectively be moveable upwardly so as to isolate radial aperture 134 through use of seals 158 and 160. At the upward extent of sleeve 156 is a radially outwardly extending collet assembly 162 which extends generally circumferentially around sleeve 156. Threadably engaged at 164 with housing member 136 is a collet receiving assembly 166. Collet receiving assembly 166 includes a radially inwardly extending shoulder 168 adapted to receive and engage collet assembly 162 on sleeve 156 to retain sleeve 156 in an upward position, when engaged.

Referring now to FIG. 4, therein is depicted an exemplary embodiment of a differential pressure operated reversing valve 40. Differential pressure reversing valve 40 includes a coupling mandrel 170 coupled to housing 34 inside gravel pack screen 32. Coupling mandrel 170 is threadably coupled at 172 to a lower housing 174. Lower housing 174 includes a radial aperture 176. Coupling mandrel 170 also includes a plurality of radial apertures 178 which are preferably longitudinally offset from radial apertures 176. Communication between apertures 176 and 178 is initially precluded by a closure sleeve 180 which sealingly engages seals 182 and 184 on housing 170 and seal 186 on lower housing assembly 174. Closure sleeve 180 is urged against an upwardly limiting shoulder 188 on coupling mandrel 170 by an extension spring 190. As will be appreciated from the disclosed apparatus, a pressure in the annulus applied through port 176 will act on closure sleeve 180 against the force of spring 190. When such pressure becomes sufficiently high, sleeve 180 will be moved downwardly, beneath seal 182, and valve 40 will thereby allow fluid communication between radial apertures 176 and 178, and therefore fluid communication between the annulus, through gravel pack screen 32, and interior bore 192 within valve 40.

As depicted in FIG. 4, in one exemplary embodiment, coupled beneath differential pressure operated circulating valve 40 is tell-tale screen assembly 44. Tell-tale screen assembly 44 includes a housing 200 having a plurality of radial apertures 202 therein. A conventional gravel pack tell-tale screen 204 surrounds housing 200 at least proximate apertures 202. A selectively moveable valve sleeve 206 is secured such as by shear pins 208 to housing 200 whereby sleeve 206 sealingly isolates apertures 202. Sleeve 206 includes a ball receiving seat 210 adapted to receive a conventional sealing ball, as is known to the industry.

Referring now to FIG. 5, therein is disclosed an exemplary embodiment of crossover sleeve 36. Crossover sleeve 36 may be a design such as the Sliding Side-Door® Circulation Valve manufactured and offered by Otis Engineering Corporation. Crossover sleeve 36 includes a housing assembly 251 which, as depicted in FIG. 5 will be within a portion of primary gravel pack screen 32. Housing assembly 251 has a plurality of radial ports 243 extending therethrough. A movable inner mandrel 245 is situated within housing 251. Mandrel 245 engages seal assemblies 253*a* and 253*b* on opposite sides of radial ports 243. Mandrel 245 thus, in a first position, precludes fluid flow between the tool interior bore 192 and the annulus through radial ports 243. Proximate the lower end of mandrel 243 are a plurality of circumferentially arranged collet fingers, indicated generally at 252. Collect fingers 252 include radially outwardly extending detent ledges 254 adapted to engage recesses in housing assembly 251. Housing assembly 251 preferably includes at least two sets of detent grooves 256,258. As depicted in FIG. 5, when detent ledge 254 engages upward detent groove 256, inner mandrel 245 is maintained in a first, upward position precluding fluid flow as described above. Inner mandrel 245 also includes a plurality of tool-engaging mechanisms, such as an upward lip 258 and lower inwardly extending flanges 260 which are adapted to engage shifting tools, in a manner well known to the art. Such shifting tools may be used to move mandrel 244 from the first position as depicted in FIG. 5 to a second position, wherein detent ledges 254 will engage lower detent groove 258. In this position, a plurality of circumferentially arranged apertures 262 will be longitudinally aligned with radial ports 243, and a flow path will be estabished between the annulus surrounding crossover sleeve 36 (through primary gravel pack screen 32), and tool interior bore 192. Interior bore 192 is, of course, only one portion of the bore through perforating/gravel pack assembly 10.

Operation of the exemplary embodiment of a perforating gravel pack apparatus 10 of FIGS. 1–5 is as follows. Perforating/gravel pack apparatus 10 will be lowered in the wellbore until perforating gun 18 is adjacent zone of interest 20. Retrievable packer 46 will then be seated to isolate a lower portion of the wellbore 50 (beneath packer 46), from an upper portion of the wellbore 51. At this time, there will be an open path through the interior of the tubing string and through perforating/gravel pack assembly 10. Accordingly, any desired conventional means for actuating perforating gun 18 may be utilized. For example, firing head 52 associated with perforating gun 18 may be either mechanically actuated, such as through use of a drop bar, or may be actuated by fluid pressure which will be communicated through tubing string 22 and either through the interior of tubing string 22 to firing head 52, or out into lower annulus 50, where firing head 52 is responsive to annulus pressure. After perforating, perforating gun 18 and firing head 52 will preferably be dropped into the bottom of wellbore 12. This may be done by any conventional means, such as, for example, an automatic gun release firing head.

Once the zone of interest 20 has been perforated (as depicted in FIG. 1B), the well will be allowed to flow as desired, such as to clean perforations, and the well will be killed. A sealing ball (shown in phantom lined in FIG. 4) may be dropped in the tubing string and allowed to rest on seating surface 210 of movable valve sleeve 206 (see FIG. 4). When a predetermined pressure, for example 1,000 psi. is reached, shear pins 208 will shear and movable sleeve 206 will shift downwardly. Sleeve 206 may be allowed to be "blown" out of the lower end of perforating/gravel pack apparatus, through the opening provided after dropping of perforating gun 18. Movement of movable sleeve 206 opens apertures 202 behind tell-tale screen 204, allowing fluid communication between the annulus and the interior bore 192 of perforating/gravel pack apparatus 10. Retrievable packer 46 will be unset, and perforating/gravel pack assembly 10 will be lowered within wellbore 12 until primary gravel pack screen 32 is adjacent zone of interest 20 (as depicted in FIG. 1C). Retrievable packer 46 will then be reset at this depth.

After this flow path is established, packer 26 may be set. The setting of packer 26 defines an upper wellbore annulus 51 above packer 26 and along wellbore 52 annulus below packer 26. Packer 26 will preferably be set by dropping "dart" assembly 220 through tubing string 22. Dart assembly 220 is depicted in dashed, "shadow", representation in FIG. 2E, in the position in which the relative components will be when dart assembly 220 is initially placed into position in closing sleeve 120 on perforating and gravel pack assembly 24.

Figure 3:
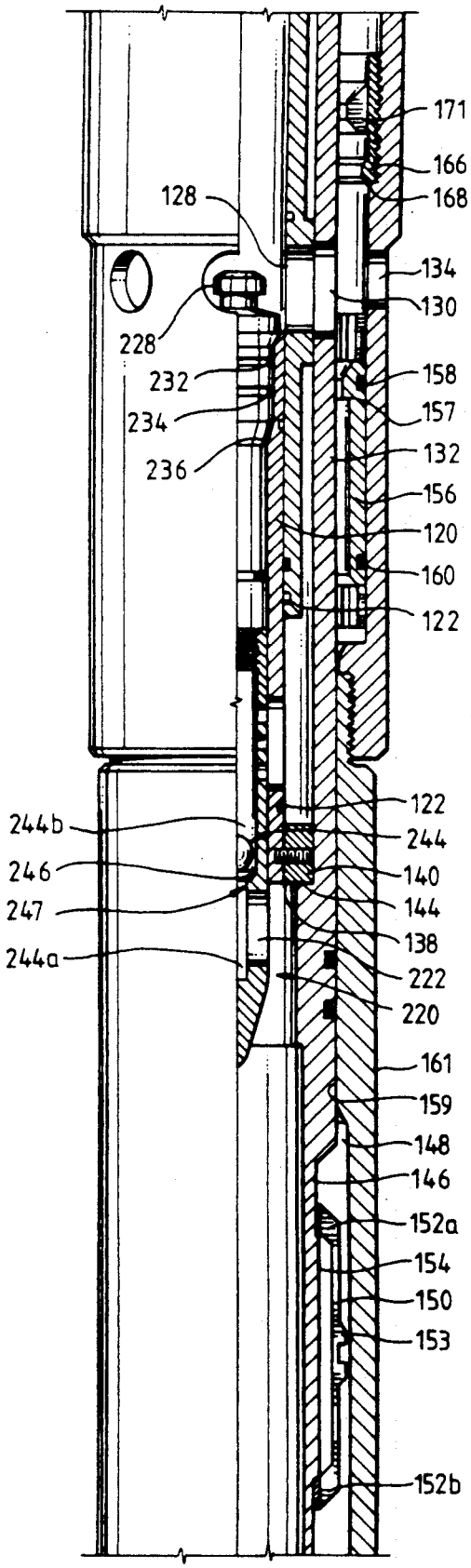
FIG. 3 depicts a portion of the packer/crossover assembly of FIG. 2, having a probe assembly disposed therein, at one stage of operation, illustrated partially in vertical section.

For purposes of this description, dart assembly 220 will be described in relation to FIG. 3. Dart assembly 220 includes an outer housing member 222. Housing assembly member 222 includes a generally conical or "bullet-shaped" lower end 224. Proximate upward end 226, housing 220 includes a radially enlarged upset portion 228 and an outwardly extending seating portion 230. Seating portion 230 is preferably placed at an upwardly extending angle, as depicted in FIG. 3. Dart housing assembly 222 includes a plurality of seals thereon. A first pair of seals 232, 234 is adapted to sealing engage an upward recess 236 in closing sleeve 120. A lower seal 238 is adapted to engage a lower portion within bore 240 of closing sleeve 120. Dart housing assembly 222 includes a plurality of lower ports 242 which communicate with an internal chamber 244 in dart housing assembly 222. Chamber 240 includes a lower portion 244*a* and an upward, radially enlarged portion 244*b*. These portions are separated from one another by a transition area 246 forming a ball seat. A check ball 248 is included within dart housing assembly 222, and acts as a check valve within dart assembly 220, allowing fluid to flow upwardly from smaller portion 244*a* of chamber 244 to radially enlarged portion 244*b*, but not in the opposite direction. A plurality of radial apertures, indicated generally at 250, provide fluid communication between radially enlarged chamber portion 244*b* to the exterior of dart assembly 220. As can be seen in FIGS. 2E and 3, when dart assembly 220 is seated within closing sleeve 120, radial ports 250 will be longitudinally aligned with ports 121 in closing sleeve 120. Dart assembly 220, which will be seated by dropping it down the tubing string, will preferably include an upper head area, indicated generally at 252, which will facilitate dart assembly 220 being retrieved from the well on wireline or slickline. As used herein, the term wireline is consider to embrace cable having electrical conductors, generically referred to as "wireline," and also cable without electrical conductors, such as is commonly referred to as "slickline."

When dart 220 is received within closing sleeve 120, fluid flow downwardly through interior bore 192 of the tool string will again be precluded, by seals 232, 234 on dart assembly 220. Accordingly, pressure may be applied through the interior of tubing string 22, to act upon actuation piston 74 through port 88, and to thereby set packer 26 in the manner described in U.S. Pat. Nos. 4,832,129 and 4,834,175, previously incorporated by reference. Once packer 26 has been set, the pressure in the tubing string may be elevated to a second threshold level to shift closing sleeve 120. In one particularly preferred embodiment, tubing pressure will be elevated to approximately 2,800 psi. to accomplish this shift. Once this threshold pressure is achieved, shear pins 122 will shear, and sleeve 120 will move downwardly with respect to inner mandrel 164 until stop block assembly 138 rests adjacent inwardly projecting ledge 144, as depicted in FIG. 3. This movement of sleeve 120 will open ports 128, 130, and 134 to the fluid annulus. The alignment of those ports thus establishes the gravel pack slurry path from the interior of tubing string 22 to the annulus.

Figure 6:
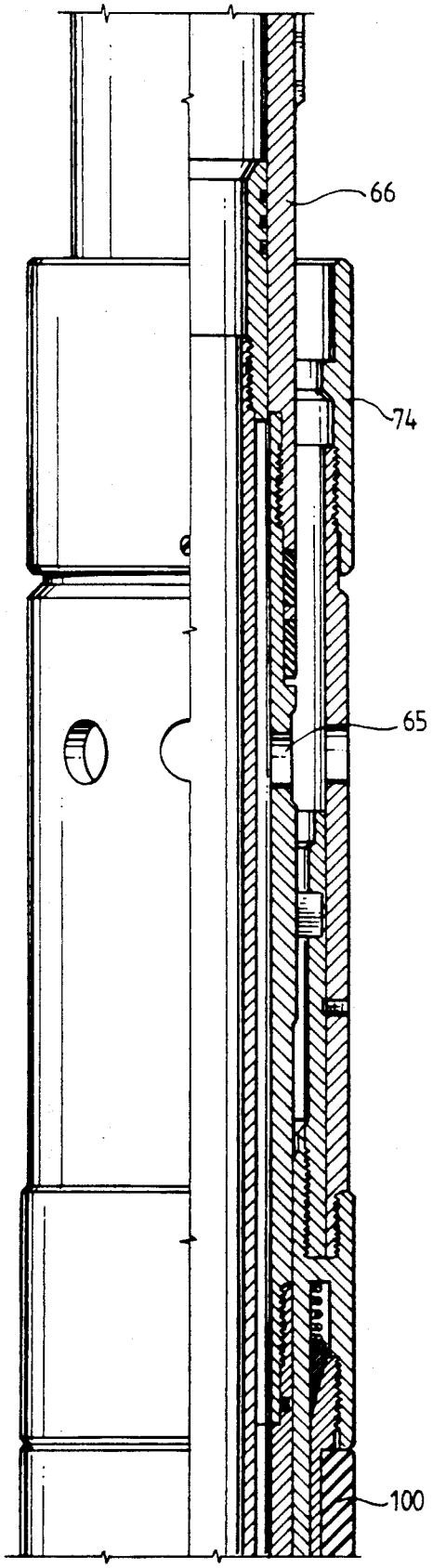
FIG. 6 depicts an upper portion of the packer/crossover assembly of FIG. 2 in one stage of manipulation, illustrated partially in vertical section.

This movement also establishes a portion of a return fluid path through aperture 242 in dart assembly 220, past check valve 247, and out through apertures 250, and through apertures 121 in closing sleeve 120 to annular return path 258 in crossover assembly 28. As depicted in FIG. 6, the annular return path 258 in crossover assembly 28 will be communicated with the upward annulus by raising tubing string 22, and attached service tool mandrel 66 to a point where crossover port 65 is elevated above tube guide 74. This eliminates the sealing engagement previously provided by seals 260 and 262 within packer mandrel 64. At this point, the annulus adjacent zone of interest 20 may then be gravel packed in a conventional manner by flowing the slurry down through the tubing string, out into the annulus through aligned apertures 128, 130, and 134, and allowing the carrier fluid to return through ports 202 within tell-tale screen assembly 44, up through interior bore 192, through the previously described path in dart assembly 220 and annular return path 258 to upper annulus 51.

As will also be apparent, differential pressure operated circulating valve 40 will be responsive to an increase of pressure in the well annulus (communicating with valve 40 through port 176), relative to the pressure of the return carrier fluid within interior bore 192. When this pressure overcomes the resistance of spring 190, closing sleeve 186 will move downwardly, providing a return flow path through valve 40. Additionally, a return flow path will be provided for fluid within screen 32 by sleeve valve 36. As noted previously, sleeve valve 36 is a wireline-shiftable valve to provide a return flow for fluid through primary gravel pack screen 32. Sleeve valve 36 may be opened prior to the commencing of introduction of the gravel pack slurry, but most preferably will be opened during the actual gravel pack operation, as fluid flow is eventually occluded through tell-tale screen assembly 44.

Once the gravel pack has been completed, tubing string 22 will be raised again, approximately 4–6 feet, to allow reversing out of the interior of tubing string in a conventional manner. This elevation of tubing string will raise radial port 130 generally above tube guide extension 74, and will allow conventional reverse circulation to displace remaining carrier fluid from the interior of tubing string 22. Additionally, this upward movement of tubing string 22 will raise bow-type collet string assembly 150 (see FIGS. 2E and 7). Upward movement of crossover mandrel 132, and therefore of bow-type collect assembly 150 will cause collet assembly 150 to deflect to pass beneath inwardly extending surface 159 of housing extension 161, but to radially expand upon passing such surface such that radially outwardly extending ledge 153 will engage shoulder 157 of sliding valve member 156. Continued upward movement of crossover mandrel 132 will move sliding valve member 156 upwardly until radially outwardly extending collet assembly 162 engages radially inwardly extending shoulder 168 of collet receiving assembly 166. Further upward movement of sliding valve member 156 is precluded by stop assembly 171. Thus, once sliding valve 156 has been moved to an upper, closed position, preventing fluid flow through radial port 134 (as depicted in FIG. 7), further upward movement of sliding valve member 156 will be precluded.

Once the reverse circulation is complete, tubing string 22 will then again be lowered, returning port 136 to a sealed engagement within tube guide extension 74. Downward movement of crossover mandrel 32, and thereby of bow-type collet assembly 150 will not effect the position of sliding valve member 156 as radially outwardly extending ledge 153 is free to pass downwardly from sliding valve member 156, and as sleeve valve 156 is retained by collet assembly 162 and collet receiving assembly 166 as described earlier herein. At such time, the tubing string may then be appropriately spaced out, and the wellhead may be connected to the tubing string in a conventional manner. At such time, dart assembly 220 may be removed from packer/crossover assembly 24. Dart assembly 220 may preferably be removed by engaging head 252 thereof with a conventional wireline-conveyed retrieving tool and pulling dart assembly 220 upwardly out of packer/crossover assembly 24.

If for some reason, such as a pressure differential, it is difficult to pull dart assembly 220 from the well through such use of a wireline and retrieving tool, pressure may be applied to the interior of tubing string 22 to establish a pressure differential in favor of the tubing string above dart assembly 220. Once such pressure differential exceeds the shear value of shear pins 142, dart assembly 220 along with closing sleeve 120 may be "blown out" of interior bore 192 of perforating/gravel pack apparatus 10, through the opening left by the dropping of perforating gun 18 and firing head 52. At this time, an open flow path is established from interior bore 192 into tubing string 22 which is suitable to serve as a production flow path for fluid from zone of interest 20 through the gravel pack annulus and gravel pack screen 32. The well may thus be placed on production. Accordingly, the well has been perforated, gravel packed, and placed on production with only a single trip of the tool string into the wellbore.

Figure 7:
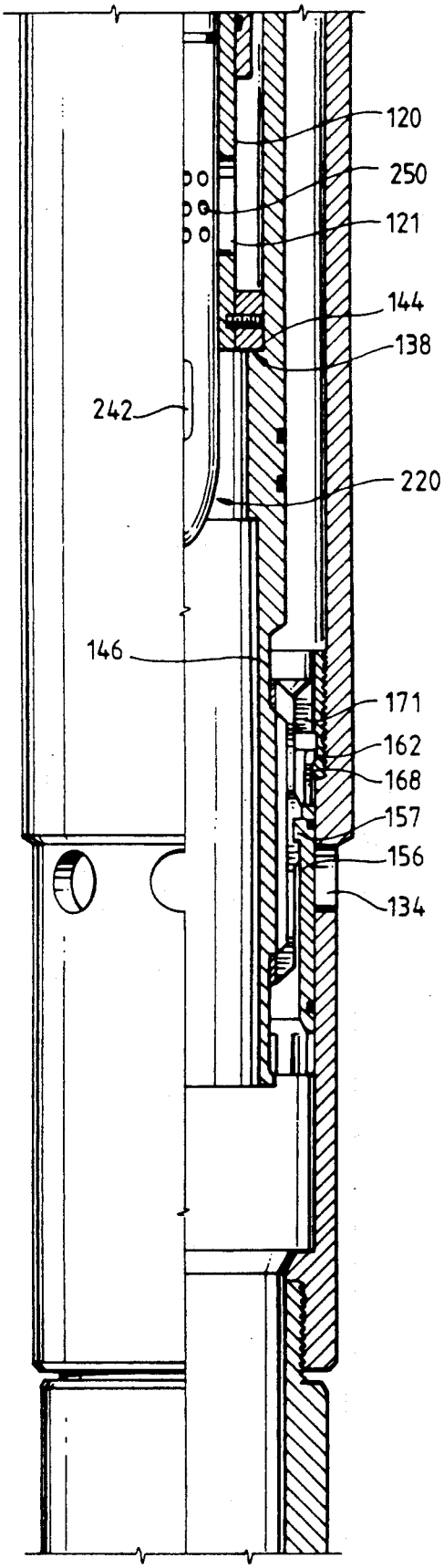
FIG. 7 depicts a second portion of the packer/crossover assembly of FIG. 2, at the same stage of manipulation as depicted in FIG. 6, illustrated partially in vertical section.

Referring now to FIG. 9, therein is depicted an alternative embodiment of a sliding sleeve valve 260 suitable for use in place of ball type sliding sleeve valve 44 as described with respect to FIGS. 1 and 7. Sliding sleeve valve 260 includes an upper sub 262 which is threadably coupled at 264 to lower sub 266. Lower sub 266 is threadably coupled at 268 to an adjacent sub or pup joint 270. Lower sub 266 includes a radially extending aperture 272 which is, in a first state of valve 260, selectively occluded by sliding sleeve 274. Lower sub 266 includes a sealing member 276, such as a conventional O-ring which engages the exterior surface of lower skirt 288 of sliding sleeve 274. Similarly, sliding sleeve 274 includes a recess 278 containing a sealing member 280, again such as a conventional O-ring. Sealing member 280 sealingly engages an inner extension surface 282 of lower sub 266.

Between aperture 272 and sealing member 276 in lower sub 266, lower sub 266 includes a radially inwardly extending upset 284. Sliding sleeve 274 is complimentarily configured such that it has a radially inwardly extending ledge 286 extending to the dimension of lower skirt 288 which engages sealing member 276. Sliding sleeve 274 also includes a radially outwardly extending upset 290 which engages a sealing surface 292 within upper sub 262. In operation, the configuration of sliding sleeve 274 provides a piston area established by the difference in dimension of the inner surface of upper extension 282 of lower sub 266, adjacent sealing member 280, and the dimension of lower skirt 288 of sliding sleeve 274, adjacent sealing member 276. Annulus pressure within aperture 272 will act upon this piston area. Once the pressure in the well annulus becomes sufficient to exert a force on the piston area which overcomes the shear value of shear pin 275, sliding sleeve 274 will move upwardly, until radially outwardly extending upset 290 engages a stop shoulder 294 within upper sub 262.

Sliding sleeve valve 260 also preferably includes a locking mechanism to retain sliding sleeve 274 in its upper, opened position, once the valve has been actuated. In the depicted preferred embodiment, this locking mechanism includes a split ring, such as a radially expansible C-ring 296 housed within a recess 298 in radially outwardly extending flange 290. As sliding sleeve 274 moves upwardly, locking ring 296 will be brought adjacent a radial locking recess 300 in upper sub 262. Split ring 296 will then expand, engaging recess 300, and presenting further movement of sliding sleeve 274.

Referring now to FIGS. 10A-B, therein is depicted a slightly modified multi-position running tool, indicated generally at 310, adapted to be utilized with a modified closure assembly, indicated generally at 312. Because modified multi-position running tool 310 and closure assembly 312 have components which are identical to multi-position running tool 60 of FIG. 2 and dart assembly 220 of FIG. 3, similar structures will be assigned the same numbers as applied to such previously described components. The combination of multi-position running tool 310 and closure assembly 312 is particularly well suited for some applications involving the use of a perforating assembly in combination with the packer and gravel packing assemblies. In certain such perforating operations, the possibility may exist that detonation of the perforating gun could be transmitted within the tubing string and, could cause premature setting of the packer. Multi-position running tool 310 includes a closure sleeve 314. Closure sleeve 314 houses a pair of seals 316, 318 which, when closure sleeve 314 is in a first position straddle and therefore isolate port 88 in tool mandrel 66 from the interior bore thereof. Sleeve 314 is retained in this first positon by a shear pin 320 which engages tool mandrel 66 and sleeve 314. A tapered transition to the inner diameter of sleeve 314 is formed by end sleeve 322, which is threadably coupled at 324 to top sub 326. Closure sleeve 314 includes an inwardly extending shoulder 328 adapted to engage an upper skirt 330, which is coupled by means of a shear pin 332 to dart 334.

Dart 334 may be of essentially the same configuration as described and depicted relative to dart 220 of FIG. 3. Dart 334, as depicted, differs from dart 220 primarily in that it includes chevron-type seals 336, 338 rather than O-ring seals on its exterior surface.

Multi-position service tool 310 also includes an additional interior sleeve 340 extending within tool mandrel 66. Interior sleeve 340 extends down to inwardly extending upset 342.

The operation of multi-position service tool 310 and closure assembly 312 during a perforating/gravel packing operation is as follows. Prior to insertion of closure assembly 312, the perforating gun will be actuated as described with resepct to the embodiment of FIGS. 1-3. During such time, any fluid pressure generated by the perforating operation within the tubing string will be isolated from port 88 and annulus 72 by closure sleeve 314. Accordingly, there should be no risk of inadvertent setting of the packer through pressure generated by the perforating operation.

Subsequently, closure assembly 312 (dart 334 having skirt 330 attached thereto), will be placed in the well and allowed to seat in the position depicted in FIG. 10A wherein sleeve 330 seats against shoulder 328 of closure sleeve 314. Pressure within the tubing string will then be evaluated to a first threshold level, for example, 500 psi, causing shearing of shear pin 320 and a downward shift of closure sleeve 314 until the lower extent of closure 314 hits the upper surface 344 of inner sleeve 340. Further movement of closure sleeve 314 will thereby be prevented.

Figure 11:
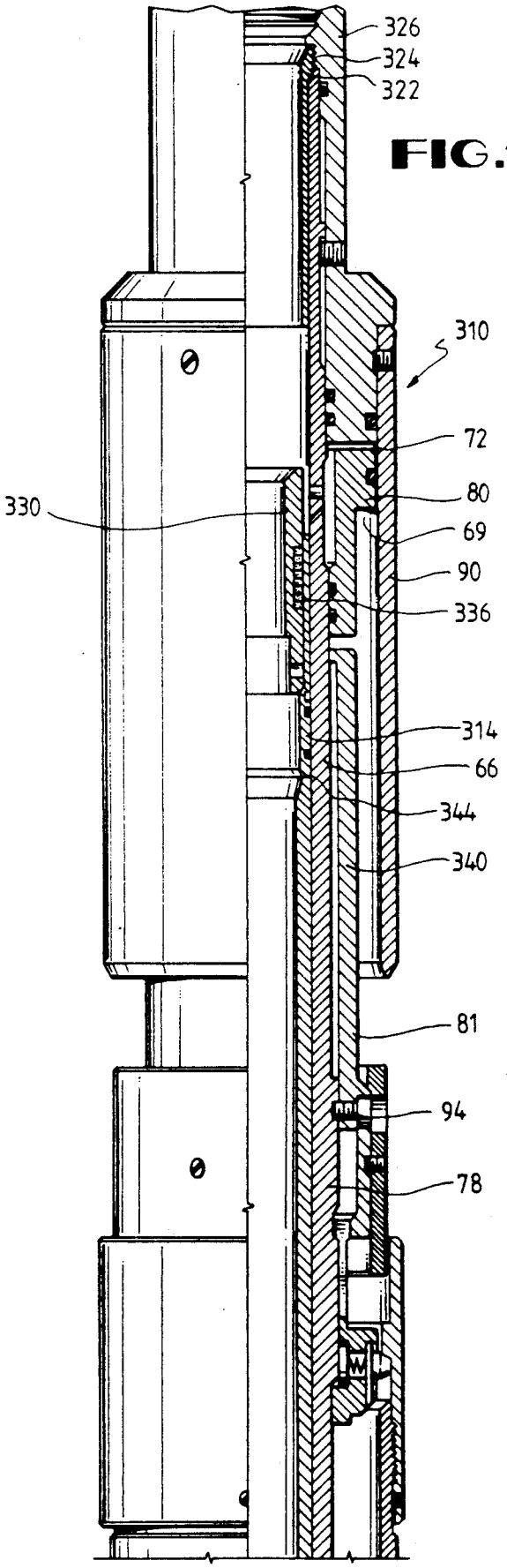
FIG. 11 depicts the apparatus of FIG. 11 at one stage during the operation prior to use of multi-position running tool to set the packer, illustrated partially in vertical section.

Referring now also to FIG. 11, the pressure within the tubing string may then be further elevated, for example, to 1,000 psi to cause the shearing of shear pin 332, thereby separating dart assembly 334 from skirt 330. Skirt 330 will remain adjacent shifted closure sleeve 314, and dart assembly 334 will be allowed to move downwardly within multi-position running tool 310 until it seats as depicted in FIG. 3 relative to the preceding embodiment. The pressure within the tubing string may then be further elevated, for example, another 1,000 psi to 2,000 psi to cause setting of packer 26 in the manner previously described.

Many modifications and variations may be made in the techniques and structures described and illustrated herein without departing from the spirit and scope of the present invention. For example, designs may be envisioned where a downhole valve, manipulable either through wireline or fluid pressure, could be implemented to selectively close the interior bore of the tool string and to provide the crossover paths described herein. Additionally, many other types of closure mechanisms placed from the surface, other than the dart assembly described herein may be envisoned for establishing all or part of such crossover paths. Accordingly, it should be readily understood that the embodiments described and illustrated herein are illustrative only, and are not to be considered as limitations upon the scope of the present invention.

What is claimed is:

1. A method for gravel packing a wellbore surrounding a tool string and for producing fluids from said wellbore on a single trip of said tool string into said wellbore, said method comprising the steps of:

lowering said tool string into said well, said tool string comprising a packer assembly and a crossover assembly, said crossover assembly having an open bore therethrough, said crossover assembly selectively operable to provide a first flow path from the interior of said tubing string at a location above said packer to the wellbore annulus below said packer, and selectively operable to provide a second flow path from the interior of said tool string below said packer to the annulus in said wellbore above said packer;

selectively closing said open interior bore of said crossover assembly to set said packer at a first level of pressure in said tubing string;

establishing a second pressure level in said tubing string, said second pressure level operating said crossover assembly to establish said first flow path;

selectively operating said crossover tool to establish said second flow path;

introducing a gravel slurry through said tubing string to said crossover assembly and thereby gravel packing said annulus surrounding said tool string;

re-establishing said open bore through said crossover assembly without removing said crossover assembly from said wellbore; and producing fluids from said wellbore through said gravel packed annulus and through said crossover assembly.

2. The method of claim 1, wherein said step of selectively closing said open bore of said crossover assembly is accomplished, at least in part, by placing a probe member in said tool string after said tool string is disposed in said wellbore.

3. The method of claim 1, wherein said tool string further comprises a perforating assembly, and wherein said method further comprises the step of perforating said wellbore.

4. The method of claim 1, wherein said step of selectively operating said crossover tool to establish said second flow path comprises the step of longitudinally moving a portion of said crossover tool.

5. The method of claim 1, wherein said step of reestablishing said open bore through said crossover assembly is accomplished by disengaging a movable member from association with said crossover assembly.

6. A gravel pack assembly for use in a tool string for gravel packing an annular area of a wellbore surrounding at least a portion of said tool string in said wellbore, said assembly adapted to be placed in said wellbore by being suspended from a tubing string, comprising:

a packer assembly;

a crossover assembly, said crossover assembly being selectively operable from a first state in which fluid communication is precluded between an interior bore of said crossover assembly and said annulus, and a second state wherein a first flow path is established communicating an upper interior portion of said crossover assembly with said annulus, and further being selectively manipulable to establish a second flow path from a lower interior portion of said crossover assembly to a wellbore annulus above said packer;

a gravel pack screen disposed around a portion of said gravel pack assembly;

a selectively operable valve member operable to allow fluid communication from the annulus in said wellbore exterior to said screen to a lower interior portion of said crossover assembly; and an operating mechanism selectively engagable with said crossover assembly to occlude fluid flow through said open bore of said crossover assembly, at least in a first direction, and to operate said crossover assembly between said first and second states.

7. The assembly of claim 6, wherein said operating mechanism comprises a probe assembly selectively insertable into said crossover assembly after said crossover assembly has been placed in said wellbore.

8. The apparatus of claim 6, wherein said crossover assembly is manipulable between said first and second states in response to hydraulic pressure applied in said tubing string.

9. A method for perforating and gravel packing a wellbore surrounding a tool string, and for producing fluids from said wellbore on a single trip of said tool string into said wellbore, said method comprising the steps of:

lowering said tool string into said well, said tool string comprising a packer assembly, and a crossover assembly, second said crossover assembly having an open bore therethrough, said crossover assembly selectively operable to provide a first flow path from the interior of said tubing string at a location above said packer to the wellbore annulus below said packer, and selectively operable to provide a second flow path from the interior of said tool string below said packer to the annulus in said wellbore above said packer;

actuating said perforating gun to perforate said formation;

selectively closing said open interior bore of said crossover assembly to set said packer at a first level of pressure in said tubing string;

establishing a second pressure level in said tubing string, said second pressure level operating said crossover assembly to establish said first flow path;

selectively operating said crossover tool to establish said second flow path;

introducing a gravel slurry through said tubing string to said crossover assembly and thereby gravel packing said annulus surrounding said tool string;

re-establishing said open bore through said crossover assembly without removing said crossover assembly from said wellbore; and producing fluids from said wellbore through said gravel packed annulus and through said crossover assembly.

10. The method of claim 9, wherein said step of selectively closing said open bore of said crossover assembly is accomplished, at least in part, by placing a probe member in said tool string after said tool string is disposed in said wellbore.

11. The method of claim 9, wherein said perforating assembly comprises a packer, and wherein said method further comprises the steps of:

setting said perforating assembly packer prior to said step of actuating said perforating gun; and unsetting said perforating assembly packer subsequent to said step of actuating said perforating gun.

12. An appatatus for using a tool string for perforating a formation penetrated by a wellbore and for gravel packing an annulus surrounding said tool string in said wellbore, said apparatus suspended from a tubing string, comprising:

a first packer assembly;

a crossover assembly selectively operable to provide a flow path from the interior of said tubing string at a location above said first packer assembly to the wellbore annulus below said first packer assembly, and selectively operable to provide a second flow path from the interior of said tool string below said first packer assembly to the annulus in said wellbore above said first packer assembly, said crossover assembly having an open bore therein;

a perforating assembly selectively operable to perforate said formation, said perforating assembly operable in response to either mechanical impact or fluid pressure; and an operating mechanism associatable with said crossover assembly for selectively closing said open bore and for selectively operating said crossover tool to establish, at least in part, said first and second flow paths.

13. The apparatus of claim 12, wherein said operating mechanism comprises an assembly adapted to be placed in said crossover assembly after said crossover assembly is placed in said wellbore.

14. The apparatus of claim 13, wherein said operating mechanism cooperatively engages a moveable member in said crossover assembly to preclude downward flow of fluid through the interior of said crossover assembly at a first degree of pressure within said tubing string.

15.The apparatus of claim 14, wherein said moveable member of said crossover assembly is moveable in response to a second level of pressure in said tubing string, wherein said movement will establish said first flow path.

16. The apparatus of claim 12, wherein said perforating assembly comprises a second packer assembly.

* * * * *